United States Patent [19]

Hou

[11] Patent Number: 5,020,409

[45] Date of Patent: Jun. 4, 1991

[54] ORNAMENTAL DISPLAY ASSEMBLY

[76] Inventor: Jack Hou, P.O. Box 78-5, Taipei, Taiwan

[21] Appl. No.: 471,832

[22] Filed: Jan. 25, 1990

[51] Int. Cl.[5] ..... G10F 1/06

[52] U.S. Cl. ..... 84/95.2

[58] Field of Search ..... 84/94.1, 94.2, 95.1, 84/95.2

[56] References Cited

U.S. PATENT DOCUMENTS 2,279,182 4/1942 Snyder ..... 84/95.1 X 2,807,118 9/1957 Reuge ..... 84/95.2 X 4,708,689 11/1987 Hou ..... 84/95.2 X

*Primary Examiner*—Brian W. Brown

*Attorney, Agent, or Firm*—Bacon & Thomas

[57] ABSTRACT

An assembly is provided for displaying an ornament to which movement is imparted by a tappet rod connected to the power output shaft of a windup music box mechanism through a transmission mechanism. An illuminated mirror is provided for reflecting the image of the moving ornament, with the illumination being energized by an electric power supply source that is activated by a switch which also activates the music box mechanism.

7 Claims, 5 Drawing Sheets

ORNAMENTAL DISPLAY ASSEMBLY

BACKGROUND OF THE INVENTION

1. Field of the Invention

The present invention generally involves the field of technology pertaining to ornamental display assemblies. More particularly, the invention relates to an improved ornamental assembly having an enhanced display structure and appearance.

2. Description of the Prior Art

It is known to provide an ornamental display assembly having various visual and sound effects. For example, a carousel provided with a plurality of ornamental figures may be caused to rotate about a common axis while also reciprocating vertically to the accompaniment of music. It is also known to provide a stationary base on which one or more ornaments are mounted and caused to move in different directions by an appropriate power drive source, such as a windup music box mechanism which also provides a desired musical accompaniment.

SUMMARY OF THE INVENTION

It is an object of the present invention to provide an improved ornamental display assembly.

It is another object of the invention to provide a display assembly wherein a desired movement is imparted to at least one ornamental figure by a windup music box mechanism wherein movement of the ornament is accompanied by a coordinated lighting effect.

It is a further object of the invention to provide an improved ornamental display assembly wherein the appearance of a moveable ornament is enhanced by additional visual effects.

These and other objects of the invention are realized by providing an ornamental display assembly wherein a desired movement is imparted to at least one ornamental figure through a transmission mechanism driven by a windup music mechanism, with the movement of the figure being enhanced in appearance through reflection in a mirror and accompanied by electric lighting effects, which effects and the operation of the music box mechanism being controlled by a switch.

Other objects, features and advantages of the invention shall become apparent from the following detailed description of preferred embodiments thereof, when taken in conjunction with the accompanying drawings wherein like reference characters refer to corresponding parts in the several views.

DETAILED DESCRIPTION OF THE PREFERRED EMBODIMENTS

Figure 1:
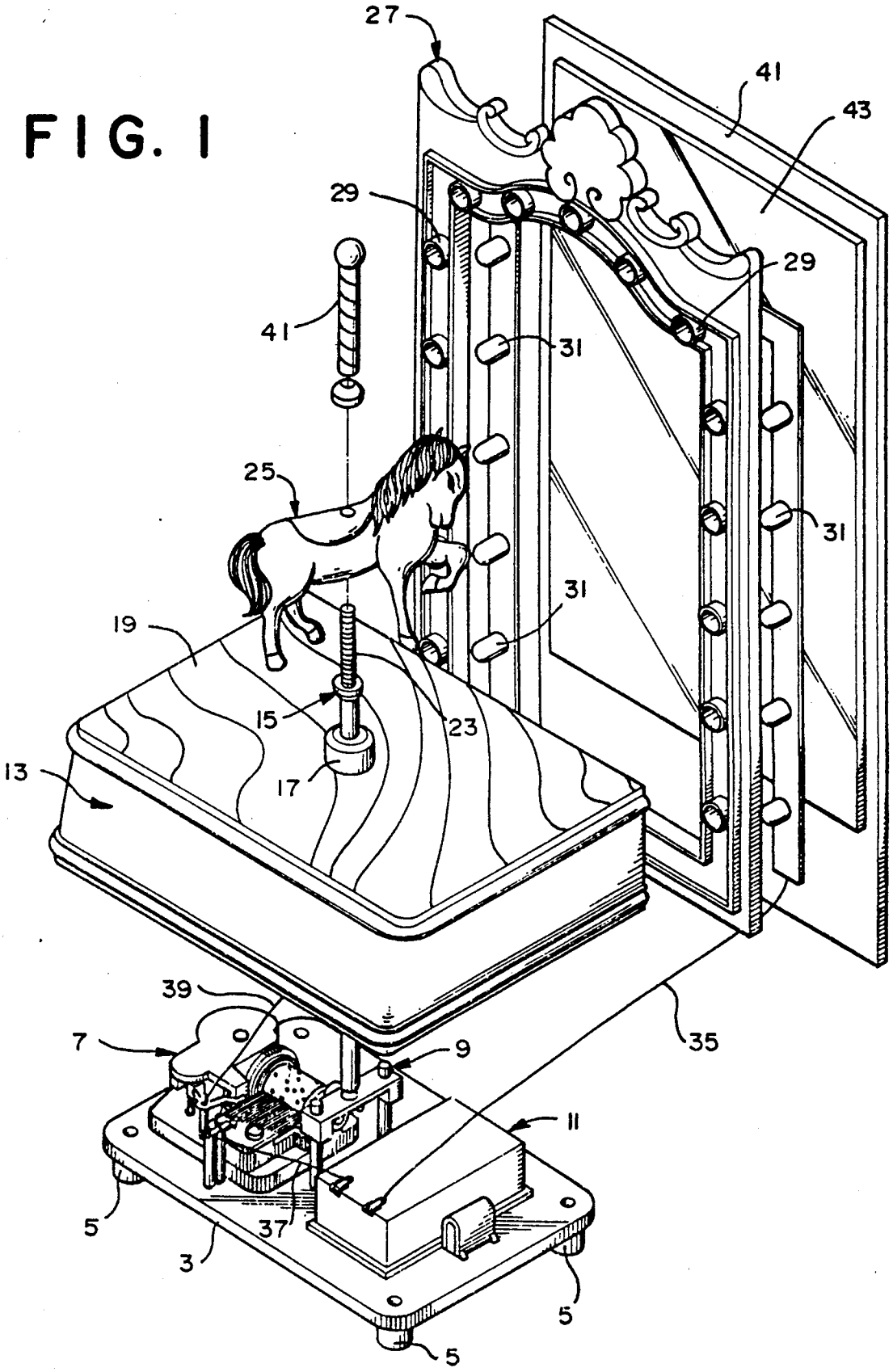
FIG. 1 is an exploded perspective view of an ornamental display assembly according to a preferred embodiment of the invention.
Figure 2:
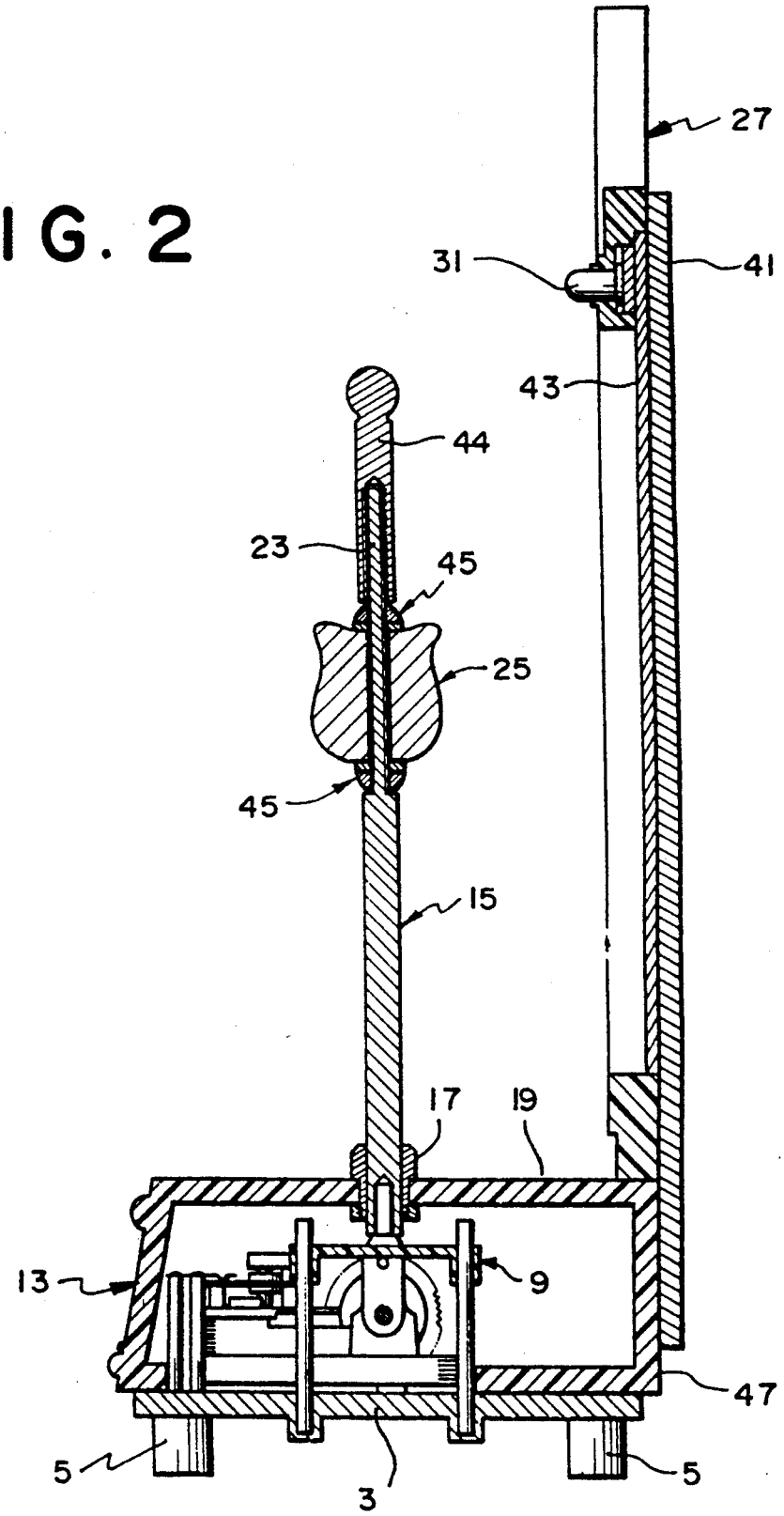
FIG. 2 is a side elevational view, taken in cross section, of the display assembly.

An ornamental display assembly 1 according to a preferred embodiment of the invention shall now be described with initial reference to FIGS. 1 and 2. As shown therein, assembly 1 includes a base 3 supported in a raised position by a plurality of legs 5 which spaces the bottom of base 3 from a support surface. A music box mechanism 7, a transmission mechanism 9 and an electric power supply source 11 are mounted on the top of base 3 and enclosed by a decorative casing 13 which may be secured to base 3 in any appropriate manner.

A tappet rod 15 is slidably journaled through a bushing 17 provided in an upper wall 19 of casing 13. Rod 15 includes a first end 21 disposed interiorly of casing 13 and in engagement with transmission mechanism 9, and a second end 23 disposed exteriorly of casing 13 for mounting an ornament 25 thereon.

A decorative rectangular frame 27 is provided with a plurality of cylindrical sockets 29 around the periphery thereof. Frame 27 is attached to the rear of casing 13 so as to extend upwardly therefrom, as seen in FIG. 2. Sockets 29 are preferably arranged in a substantially U-shaped configuration and receive a plurality of corresponding electric light bulbs 31 therethrough. Bulbs 31 are carried by a support strip 33 that is also provided with a plurality of conductive wires 35, 37 and 39 which define an electric circuit between bulbs 31, electric power supply source 11 and music box mechanism 7 for purposes to be later described. Strip 33 is maintained on frame 27 by a rectangular backing plate 41 having an associated mirror 43. Thus, when frame 27, strip 33 and plate 41 are assembled together in any appropriate manner, ornament 25 is framed by bulbs 31 and reflected in mirror 43. This arrangement is more particularly shown in the assembled side elevational view shown in FIG. 2. As also seen in the latter figure, second end 23 of rod 15 is preferably threaded and inserted through FIG. 25, and engaged within a hollow correspondingly threaded top portion 44. An appropriate washer assembly 45 may be provided on opposite sides of ornament 25 for decorative and support purposes. However, it is understood that ornament 25 may be mounted on rod 15 in any other appropriate manner. As also seen in FIG. 2, the lower edge of frame 27 is secured to upper surface 19 of casing 13 and the lower portion of plate 41 is secured to a rear vertical wall 47 of casing 13.

Figure 3:
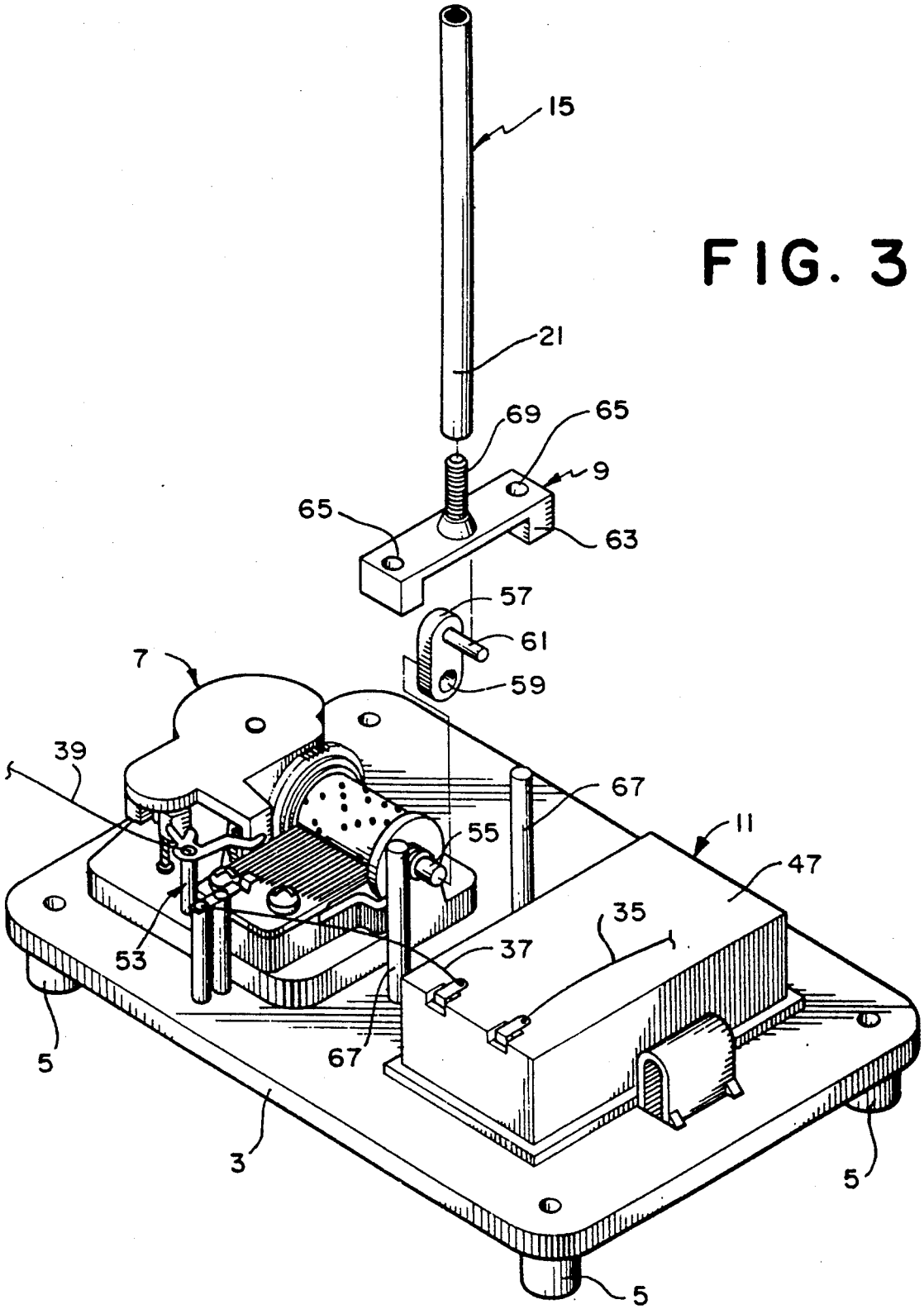
FIG. 3 is a partial exploded perspective view of the display assembly particularly depicting the details of the transmission mechanism and the manner in which it is driven by the windup music box mechanism.

With reference now to FIG. 3, electric power supply source 11 may be of a conventional type and includes a rectangular casing 47 for housing one or more standard batteries (not shown) which may be placed within or removed from casing 47 through an appropriate access cover (not shown) positioned at the bottom of base 3. Casing 47 is also provided with a pair of electric contacts 49 and 51 which are connected to wires 37 and 35, respectively, for completing an electric circuit with the batteries.

Music box mechanism 7 is of a conventional type and includes a spring windup key (not shown) and a rotatable ON and OFF switch 53, with both the key and switch 53 being accessed from the bottom of base 3. Mechanism 7 also includes a rotary power output shaft 55 for driving transmission mechanism 9. As seen in FIG. 3, mechanism 9 includes a cam member 57 provided with a passage 59 therethrough for receiving shaft 55 and securing member 57 thereto. An eccentric cam element 61 extends outwardly from member 57 for engaging a cam follower 63, the latter being provided with a pair of spaced passages 65 for slidably mounting follower 63 on a pair of vertical guide rods 67 extending upwardly from the top of base 3. A threaded shaft 69 extends upwardly from follower 63 for threaded engagement within first end 21 of tappet rod 15.

Figure 4:
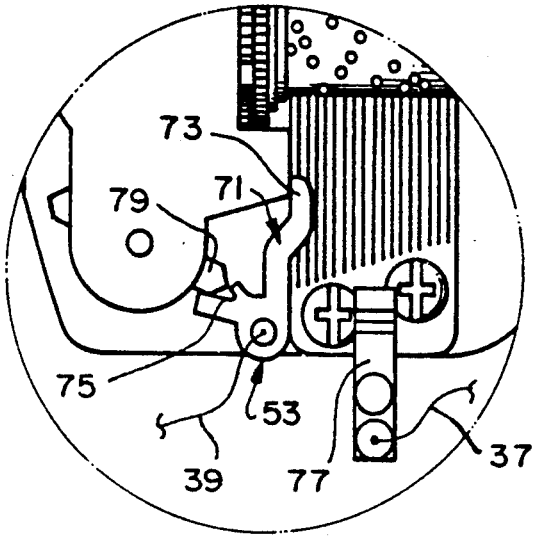
FIG. 4 is a partial view of the switch for controlling the operation of the music box mechanism and actuation of the electric lighting effects, with the switch being shown in a OFF position.

The manner in which music box mechanism 7 and lights 31 are actuated shall now be described with reference to FIGS. 4 and 5. As first seen in FIG. 4, switch 53 of mechanism 7 includes a first contact member 71 mounted at the upper end thereof for rotation thereby between ON and OFF positions. Member 71 is electrically connected to wire 39 and includes an arm portion 73 and a detent portion 75. A second contact member 77 is spaced from switch 53 and electrically connected to wire 37. Music box mechanism 7 includes a conventional rotating fly wheel 79. Switch 53 is depicted in the OFF position in FIG. 4, thereby placing detent portion 75 of member 71 in engagement against fly wheel 79 and preventing operation of mechanism 7. Arm portion 73 is out of engagement with contact member 77, thereby opening the electric circuit defined by wires 35, 37 and 39. Thus, mechanism 7 is rendered inoperative and lights 31 remain unlit when switch 53 is in the OFF position depicted in FIG. 4.

Figure 5:
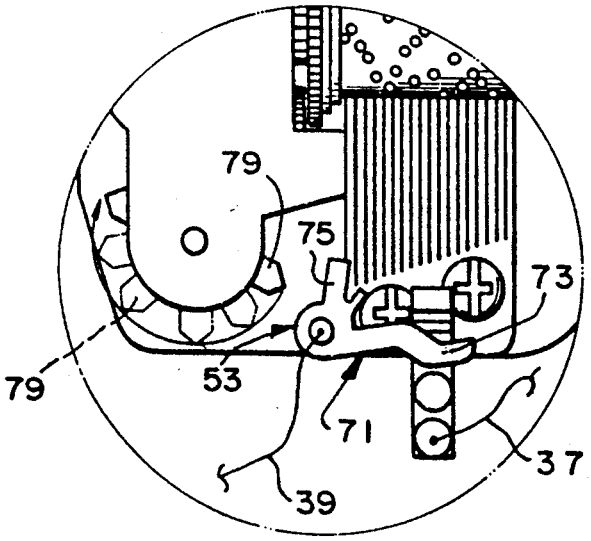
FIG. 5 is similar to FIG. 3, but depicts the switch in an ON position.

However, when switch 53 is rotated in a clockwise direction to the position shown in FIG. 5, detent portion 75 of member 71 releases fly wheel 79 for free rotation and arm portion 73 is disposed in engagement with contact member 77, thereby closing the electric circuit defined by wires 35, 37 and 39. This serves to place switch 53 in the ON position and permits operation of mechanism 7 and activation of lights 31. It is understood that lights 31 may be connected together in electric circuitry with wires 35, 37 and 39 in any conventional manner for the practice of the invention as described herein. It is also preferred that known electric or electronic means, such as an LRC circuit, be incorporated in the electric circuitry to permit sequential, alternating or flashing activation of lights 31 to provide more entertaining and enhanced lighting effects accompanying the movement of ornament 25.

Figure 6A:
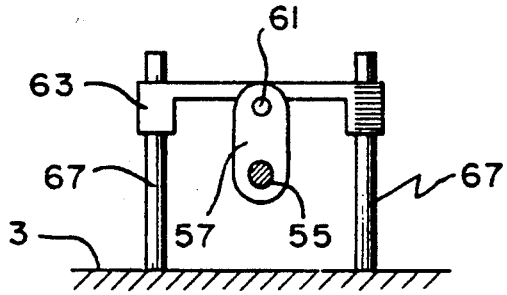
FIGS. 6A through 6E depict the sequential operation of the transmission mechanism for imparting movement to an ornamental figure supported on a tappet rod.
Figure 6B:
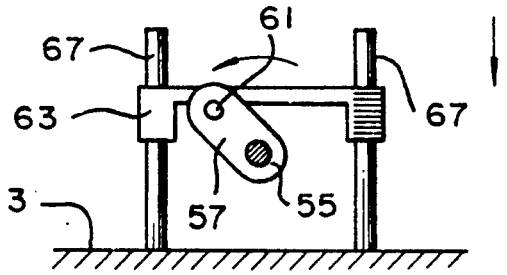
Figure 6C:
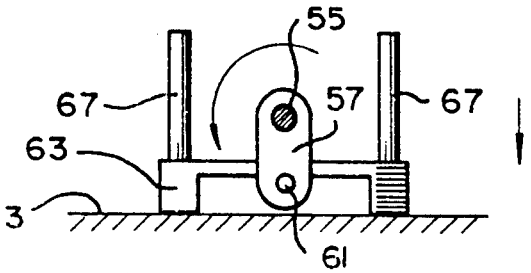
Figure 6D:
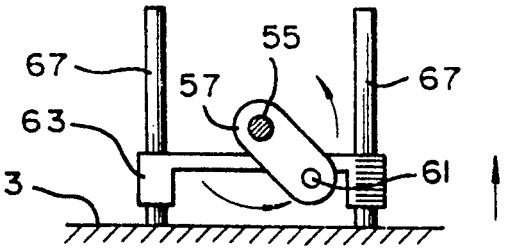
Figure 6E:
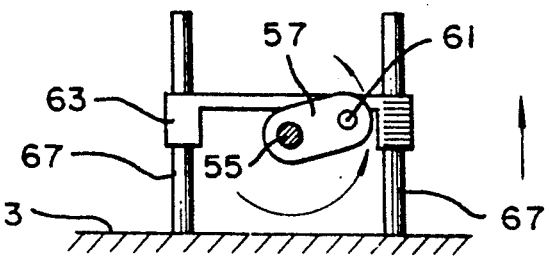

The operation of transmission mechanism 9 for imparting movement to tappet rod 15 and ornament 25 shall now be described with sequential reference to FIGS. 6A through 6E. As first seen in FIG. 6A, cam element 61 is disposed in engagement with cam follower 63, with the latter being positioned at its highest point on guide rods 67, thus also placing rod 15 and ornament 25 (not shown herein) at their highest point. When power output shaft 55 is rotated in a counterclockwise direction upon actuation of music box mechanism 7, corresponding rotation is imparted to cam member 57 and cam element 61, as shown in FIG. 6B. This causes cam follower 63 to proceed downwardly on guide rod 67 until it reaches its lowermost position depicted in FIG. 6C. Thereafter, continued rotation of cam member 57 causes element 61 to begin raising cam follower 63, as seen in FIG. 6D, with such movement continuing to the position shown in FIG. 6E at which point follower 63 is again at its highest position previously indicated in FIG. 6A. The raising and lowering of cam follower 63 in this manner serves to impart a corresponding vertical reciprocating movement to tappet rod 15 and ornament 25. Though transmission mechanism 9 is preferred for the practice of the invention in that it converts the rotary motion of power output shaft 55 to a reciprocating motion for ornament 25, it is understood that other forms of transmission or motion converting mechanisms may also be utilized. For example, appropriate gearing and linkage systems may be utilized to transmit the rotary motion of shaft 55 to another rotary motion at a right angle thereto in order to impart a corresponding rotary motion to an ornament.

It is to be understood that the forms of the invention herein shown and described are to be taken as preferred embodiments thereof, and that various changes in shape, material, size and arrangement of parts may be resorted to without departing from the spirit of the invention or scope of the subjoined claims.

I claim:

1. An ornamental display assembly comprising:

(a) a windup music box mechanism having a rotary power output shaft;

(b) a tappet rod having first and second ends;

(c) transmission means connected to the power output shaft for imparting a corresponding movement to the tappet rod in response to rotation of the power output shaft and including a cam member mounted on the power output shaft, an eccentric cam element carried by the cam member, a cam follower engaged by the cam element for raising and lowering the cam follower, means for guiding the movement of the cam follower, and the first end of the tappet rod being secured to the cam follower;

(d) a base unit, the power drive source and transmission means being supported on the base unit;

(e) a casing carried by the base unit, the casing enclosing the power drive source and transmission means, the first end of the tappet rod being disposed interiorly of the casing and the second end of the tappet rod being disposed exteriorly of the casing for mounting an ornament thereon; and (f) a mirror secured to a rear portion of the casing and extending vertically therefrom for reflecting the image of the ornament.

2. The display assembly of claim 1 further including:

(a) an electric power supply mounted on the base unit;

(b) electric light means surrounding at least a portion of the mirror;

(c) electric circuit means connecting the light means with the power supply; and (d) switch means for activating the music box mechanism and the light means.

3. The display assembly of claim 2 wherein the electric light means includes a plurality of individual lights and the circuit means includes means for sequentially activating the lights.

4. The display assembly of claim 2 wherein the light means includes a plurality of individual lights and the circuit means includes means for periodically activating the lights.

5. An ornamental display assembly comprising:

(a) a windup music box mechanism provided with a rotary power output shaft;

(b) a tappet rod having first and second ends;

(c) transmission means connected to the power output shaft for imparting a corresponding movement to the tappet rod in response to rotation of the power output shaft and including a cam member mounted on the power output shaft, an eccentric cam element carried by the cam member, a cam follower engaged by the cam element for raising and lowering the cam follower, means for guiding the movement of the cam follower, and the first end of the tappet rod being secured to the cam follower;

(d) a base unit, the power drive source and transmission means being supported on the base unit;

(e) a casing carried by the base unit, the casing enclosing the power drive source and transmission means, the first end of the tappet rod being disposed interiorly of the casing and the second end of the tappet rod being disposed exteriorly of the casing for mounting an ornament thereon;

(f) a support means secured to a rear position of the casing and extending vertically therefrom;

(g) electric light means carried by the support means;

(h) an electric power supply source;

(i) electric circuit means connecting the light means to the power supply source; and (j) switch means for activating the music box mechanism and the light means.

6. The display assembly of claim 5 wherein the electric light means includes a plurality of individual lights and the circuit means includes means for sequentially activating the lights.

7. The display assembly of claim 5 wherein the light means includes a plurality of individual lights and the circuit means includes means for periodically activating the lights.

* * * * *